US012441498B2

(12) United States Patent
Monti

(10) Patent No.: US 12,441,498 B2
(45) Date of Patent: Oct. 14, 2025

(54) APPARATUS FOR COUNTING AND UNLOADING PHARMACEUTICAL ARTICLES

(71) Applicant: Marchesini Group S.P.A., Pianoro (IT)

(72) Inventor: Giuseppe Monti, Pianoro (IT)

(73) Assignee: Marchesini Group S.P.A. (IT)

( * ) Notice: Subject to any disclaimer, the term of this patent is extended or adjusted under 35 U.S.C. 154(b) by 198 days.

(21) Appl. No.: 18/555,604

(22) PCT Filed: Apr. 15, 2022

(86) PCT No.: PCT/IB2022/053567
§ 371 (c)(1),
(2) Date: Oct. 16, 2023

(87) PCT Pub. No.: WO2022/224108
PCT Pub. Date: Oct. 27, 2022

(65) Prior Publication Data

US 2024/0199250 A1 Jun. 20, 2024

(30) Foreign Application Priority Data

Apr. 22, 2021 (IT) ..... 102021000010202

(51) Int. Cl.
*B65B 5/10* (2006.01)
*B65B 39/00* (2006.01)
*B65B 57/20* (2006.01)

(52) U.S. Cl.
CPC ..... *B65B 5/103* (2013.01); *B65B 39/002* (2013.01); *B65B 39/005* (2013.01); *B65B 57/20* (2013.01)

(58) Field of Classification Search
CPC ..... B65B 5/103; B65B 39/002; B65B 39/005; B65B 57/20
(Continued)

(56) References Cited

U.S. PATENT DOCUMENTS 5,009,345 A 4/1991 McSweeney et al.
7,036,679 B2 * 5/2006 Baranowski ..... B65B 57/14 221/13
(Continued)

FOREIGN PATENT DOCUMENTS

KR 20140124501 A 10/2014
WO 0121510 A1 3/2001
WO 2020178706 A1 9/2020

OTHER PUBLICATIONS

International Search Report dated Jun. 28, 2022.
Opinion of the International Searching Authority (PCT) dated Jun. 28, 2022.

*Primary Examiner* — Michael G Lee
(74) *Attorney, Agent, or Firm* — Endurance Law Group PLC

(57) ABSTRACT

An apparatus for counting and unloading pharmaceutical articles comprising an accumulation chamber. The accumulation chamber has an unloading mouth. A closing element of the unloading mouth is movable between a first closed and second open positions. The closing element comprises first and second abutment surfaces arranged at an angle to one another, in such a way that with the closing element positioned in the first closed position, the first abutment surface is inclined with respect to a first internal wall of the accumulation chamber defining a first accumulation volume for a first group of pharmaceutical articles between the first abutment surface and the first internal wall. The second abutment surface is inclined and with a second angle with respect to a second internal wall of the accumulation chamber defining a second accumulation volume for a second group of pharmaceutical articles between the second abutment surface and the second internal wall.

13 Claims, 4 Drawing Sheets

(58) Field of Classification Search
USPC ..... 221/7
See application file for complete search history.

(56) References Cited

U.S. PATENT DOCUMENTS

| | | | | |
|---|---|---|---|---|
| 10,189,590 | B2 | 1/2019 | Franz | |
| 2014/0097195 | A1* | 4/2014 | Anthony | G16H 20/13 221/13 |
| 2022/0172813 | A1* | 6/2022 | Sakhareliya | G16H 70/40 |
| 2023/0196800 | A1* | 6/2023 | Sukalski | G06V 20/60 382/128 |

* cited by examiner

APPARATUS FOR COUNTING AND UNLOADING PHARMACEUTICAL ARTICLES

FIELD OF THE INVENTION

The present invention relates to the technical sector relating to the filling of bottles with pharmaceutical or para-pharmaceutical articles, such as for example tablets.

In particular, the present invention relates to an apparatus for counting pharmaceutical articles, being tablets, and for subsequently unloading the articles for insertion into relative bottles.

DESCRIPTION OF THE PRIOR ART

There is an established need for each bottle to be filled with the exact number of pharmaceutical articles destined for placement on the market.

It is therefore necessary to first make a count of the pharmaceutical articles before inserting them in a relative bottle.

In this regard, apparatuses are known, which in the sector are known as counter-fillers, which carry out the count and unloading of the pharmaceutical articles for the insertion of the articles into a bottle.

Pharmaceutical articles are usually accumulated inside a storage hopper while the bottles to be filled are advanced one following another along a conveying line, for example constituted by a screw conveyor.

To transport the pharmaceutical articles from the storage hopper to a filling area above the bottles advancing along the conveying line, a vibrating conveyor is used, which is provided with a series of transport channels having a "V" shape, into which the pharmaceutical articles exiting from the storage hopper are deposited.

The vibrating conveyor, with its vibrating motion, advances the pharmaceutical articles, deposited into the various transport channels, distancing them one from the others.

A known counter-filler apparatus for carrying out the count of the pharmaceutical articles coming from the vibrating conveyor, and for the unloading thereof for the subsequent insertion thereof into bottles advancing along the conveying line, is realised in the following way, and illustrated by way of example in FIG. 1.

The known apparatus (A) comprises a plurality of descent channels (C) arranged vertically and which are configured to internally receive, by force of gravity, the pharmaceutical articles falling from the vibrating conveyor (not illustrated in FIG. 1), and an accumulation chamber (CA) arranged inferiorly of the descent channels (C). The pharmaceutical articles thus cross the descent channels (C) by force of gravity to be conveyed and unloaded in the accumulation chamber (CA).

The apparatus comprise suitable sensor means (not illustrated in detail in FIG. 1), which are arranged so as to be able to count the pharmaceutical articles that fall internally of each descent channel (C), and which are configured in such a way as to provide the apparatus with a datum relative to the overall number of pharmaceutical articles present internally of the descent channels (C).

The accumulation chamber, generally having a funnel shape, is predisposed to receive and accumulate the pharmaceutical articles exiting from the exit openings of the various descent channels (C), up to the number necessary for the unloading thereof and the following insertion thereof into a relative bottle.

This accumulation chamber (CA) superiorly comprises a loading mouth (R), located below the descent channels (C), and, inferiorly, an unloading mouth (S) for unloading the articles counted and accumulated internally thereof.

The apparatus (A) also has closing elements (G) (alike to gates) of the descent channels (C), which are activatable for closing the descent channels (C) once there is the necessary number of pharmaceutical articles in the accumulation chamber (CA) to fill a bottle.

In order to allow the accumulation of the necessary number of pharmaceutical articles to be inserted in a bottle, the apparatus (A) comprises a closing plate (SP) (i.e. a sort of hatch door) for the closing/opening of the unloading mouth (S) of the accumulation chamber (CA).

The closing plate (SP) is translatable transversally with respect to the unloading mouth (S) (FIG. 1 gives an example according to a plane perpendicular to the sheet) in order to close the unloading mouth (S), and allow the accumulation and count of the pharmaceutical articles internally thereof, and is then translatable transversally with respect to the unloading mouth (S) so as to open the unloading mouth (S) and enable the unloading of the pharmaceutical articles towards a bottle (F) to be filled.

For this purpose, the apparatus (A) is arranged in such a way that the unloading mouth of the accumulation chamber (CA) is located above the conveying line (L) of the bottles (F).

Generally, there can be a tubular connecting element (S) below the unloading mouth (T), for connecting the unloading mouth (S) with the mouth of a bottle (F), which connecting element is positioned by the conveying line paused below the apparatus (A).

The closing plate (SP) is positioned in such a way as to close the unloading mouth (S) until there is the necessary number of pharmaceutical articles in the accumulation chamber (CA) to fill a bottle.

Then, as soon as the number of pharmaceutical articles (CA) necessary to fill the bottle has fallen into the accumulation chamber, the closing elements (G) of the descent channels (C) are activated to close the descent channels (C), while the closing plate (SP) is translated so as to open the unloading mouth (S) and enable the unloading of the pharmaceutical articles towards the bottle (F).

As previously mentioned, the accumulation chamber (CA) has a funnel conformation towards the unloading mouth (S), i.e. with at least a pair of walls (P1, P2) which are convergent towards one another and convergent towards the unloading mouth (S), with the purpose of facilitating the conveying and directing of the pharmaceutical articles which are accumulating internally of the accumulation chamber (CA) above the closing plate (SP) of the unloading mouth (S).

Therefore, above the closing plate (SP), during the count of the pharmaceutical articles falling from the descent channels (S), an indistinct accumulation and piling of pharmaceutical articles is progressively formed.

The orientation and arrangement of the pharmaceutical articles which accumulate above the closing plate, and between the lower portions of the convergent walls (P1, P2) of the accumulation chamber (CA), cannot be predetermined, depending on the shape, dimension and number of the pharmaceutical articles which are to be accumulated, and will therefore be entirely random and irregular.

In substance, above the closing plate (SP), and between the lower portions of the convergent walls (P1, P2) of the accumulation chamber (CA), an indistinct and disordered pile of pharmaceutical articles is formed which articles must then be unloaded via the unloading mouth (S) as soon as the count necessary for filling a bottle has been reached.

For reasons of productivity, dictated by the number of bottles which are to be filled in the unit of time, and therefore also by the advancement frequency of the bottles by the conveying line, the unloading of the pharmaceutical articles must take place extremely rapidly and the closing plate (SP) must be translated sharply in order to open and close the unloading mouth (S) almost instantaneously.

The unloading mouth (S), in fact, must also be reclosed immediately in order to prevent any further pharmaceutical articles from being released by the descent channels in the meantime, which pharmaceutical articles are destined to a following bottle, and falling through the still-open unloading mouth to thus be unloaded into the wrong bottle.

These sharp opening and closing modalities, by means of the instantaneous translation of the closing plate (SP) of the unloading mouth (S), can lead to various drawbacks.

In fact it has been found that a part of the pharmaceutical articles of the indistinct and disordered pile of pharmaceutical articles accumulated on the closing plate is not correctly unloaded in the fraction of time of opening of the unloading mouth (S), the part remaining blocked inside the accumulation chamber.

In these circumstances, it will not be possible for the bottles to be filled with the correct and required number of pharmaceutical articles.

Further, the subsequent sharp closure of the closing plate can cause impacts against the pharmaceutical articles still present and blocked at the unloading mouth, thus causing them to rebound internally of the accumulation chamber. This can lead to damage to the articles, as well as the missed unloading thereof, for which reason they will become added, in an indistinct and unpreventable way, to the successive pharmaceutical articles released by the descent channels, with a consequent variation in the count thereof and an ensuing repercussion on the following bottles to be filled.

SUMMARY OF THE INVENTION

The aim of the present invention is therefore to provide a counter-filler apparatus for counting and unloading pharmaceutical articles able to obviate the drawbacks present in the prior-art apparatuses described in the foregoing. In particular, an aim of the present invention is to propose a new apparatus able to effectively, reliably and precisely carry out the unloading of the pharmaceutical articles accumulated in the accumulation chamber.

The above aims are obtained according to an apparatus for counting and unloading pharmaceutical articles, according to the contents of the claims.

BRIEF DESCRIPTION OF THE DRAWINGS

The characteristics of preferred, but not exclusive, embodiments of the apparatus for counting and unloading pharmaceutical articles of the present invention will be described in the following with reference to the appended 15 tables of drawings, in which.

DESCRIPTION OF THE PREFERRED EMBODIMENTS

Figure 1:
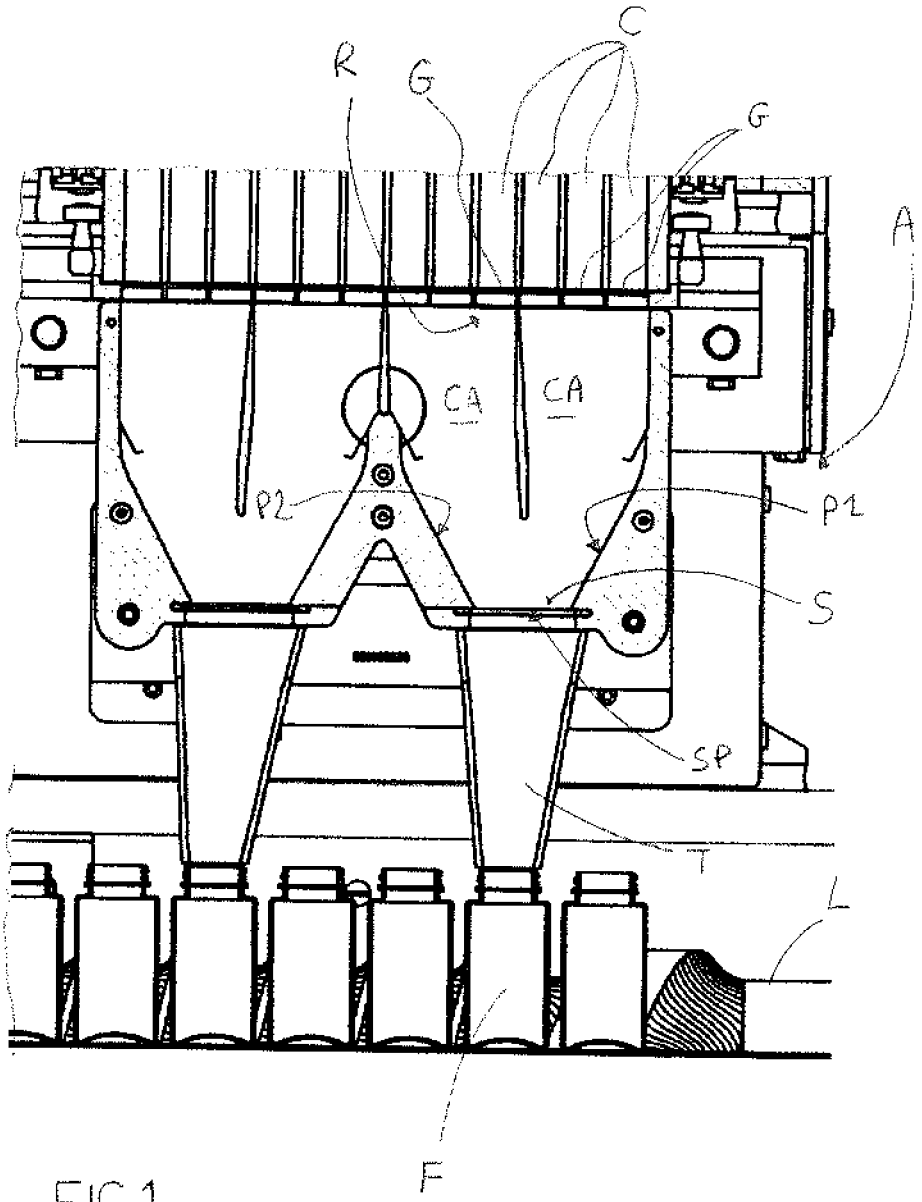
FIG.1 PRIOR ART
FIG. 1, already cited in the foregoing, schematically illustrates, in a frontal view and in vertical section, the apparatus for counting and unloading pharmaceutical articles of the prior art, described in the foregoing.

With reference to the accompanying tables of drawings, reference number (100) denotes the apparatus for counting and unloading pharmaceutical articles, such as for example tablets, object of the present invention, in its entirety.

The apparatus (100) comprises a plurality of descent channels (40) which are configured so as to receive internally thereof pharmaceutical articles, and an accumulation chamber (60), which is arranged below the descent channels (40) and which is conformed in such a way as to comprise an entry mouth (50) for receiving the pharmaceutical articles exiting from the descent channels (40) and an unloading mouth (63) for unloading the pharmaceutical articles.

The descent channels (40) are configured and arranged so as to receive internally thereof pharmaceutical articles falling from a conveyor, for example a vibrating conveyor (not illustrated in the figures as of known type and not relevant to the invention).

The apparatus (100) also has blocking elements (45) which are activatable to open/close the descent channels (40), for example at the outlet terminal parts of the pharmaceutical articles which are located at the inlet mouth (50) of the accumulation chamber (60).

The blocking elements (45) are activatable to open the descent channels (40) and enable the falling of the pharmaceutical articles into the accumulation chamber (60) and to close the descent channels (40) when the number of pharmaceutical articles that have fallen into the accumulation chamber (60) has reached a predetermined value, corresponding to the number of pharmaceutical articles that are to be unloaded and inserted in a corresponding bottle.

The apparatus (100) further comprises a closing element (65) which is arranged and movable with respect to the unloading mouth (63) in such a way as to be movable between a first closed position (O1), in which the closing element (65) is positioned at the unloading mouth (63), in order to close the unloading mouth (63) and enable the accumulation of the pharmaceutical articles internally of the accumulation chamber (60) above the closing element (65), and a second open position (O2), in which the closing element (65) is completely removed from the unloading mouth (63) in order to free and open the unloading mouth (63) for unloading the pharmaceutical articles accumulated in the accumulation chamber (60).

Figure 2B:
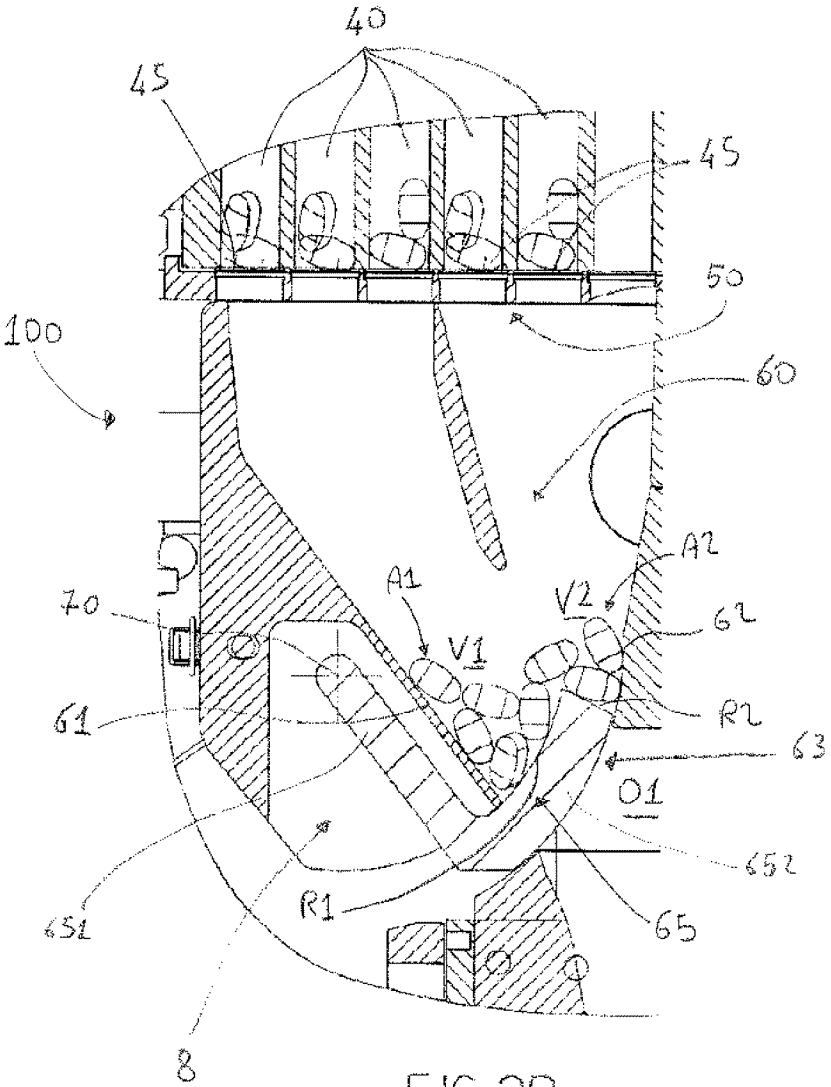
FIG. 2B illustrates, in a view in vertical section, the apparatus of FIG. 2A in an operating configuration for accumulation of pharmaceutical articles.
Figure 2A:
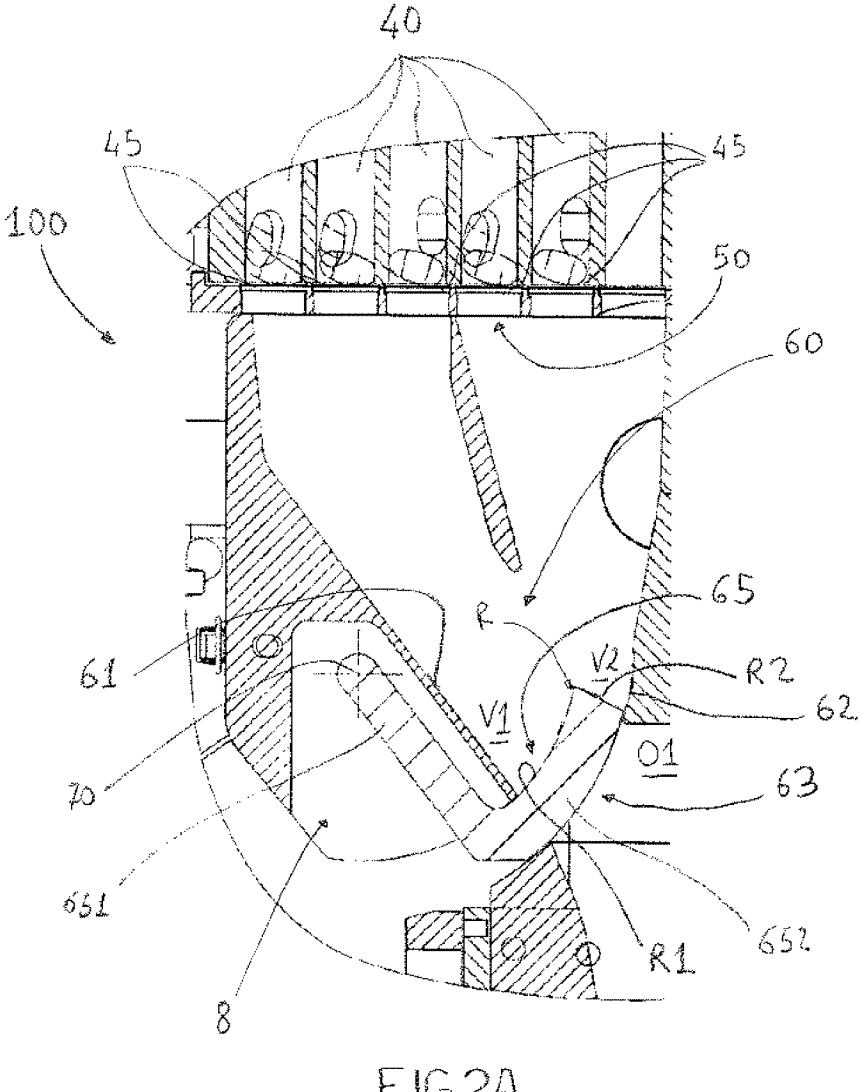
FIG. 2A schematically illustrates, in a frontal view and in vertical section, a preferred embodiment of the apparatus of the invention.

The special characteristics of the apparatus (100) of the invention consist in the fact that the closing element (65) is configured and conformed in such a way as to comprise a first abutment surface (R1) and a second abutment surface (R2) which are arranged at an angle to one another, and that the accumulation chamber (60) and the closing element (65) are reciprocally arranged and configured in such a way that (see in particular FIGS. 2A, 2B, 4A):

with the closing element (65) being positioned in the first closed position (O1) at the unloading mouth (63) in order to close the unloading mouth (63), the first abutment surface (R1) is arranged in the accumulation chamber (60) inclined and with a first angle with respect to a first internal wall (61) of the accumulation chamber (60) defining a first accumulation volume (V1) for the pharmaceutical articles between the first abutment surface (R1) and the first internal wall (61), and the second abutment surface (R2) is arranged inside the accumulation chamber (60) inclined and with a second angle with respect to a second internal wall (62) of the accumulation chamber (60), opposite the first internal wall (61), defining a second accumulation volume (V2) for the pharmaceutical articles between the second abutment surface (R2) and the second internal wall (62), in such a way that the pharmaceutical articles falling from the descent channels (40) can accumulate into a first group (A1) of pharmaceutical articles in the first accumulation volume (V1) and into a second group (A2) of pharmaceutical articles in the second accumulation volume (V2).

Figure 3B:
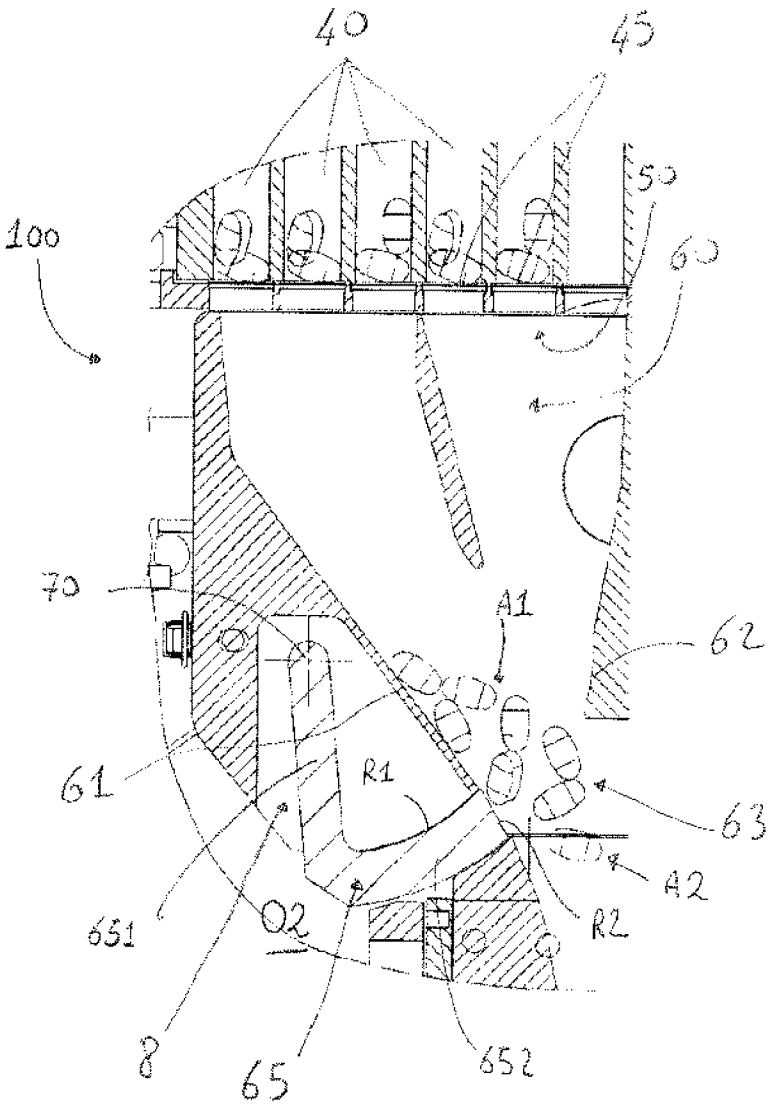
FIGS. 3A and 3B illustrate, in respective frontal and section views, the apparatus of FIG. 2A in an operating sequence of unloading of the pharmaceutical articles.
Figure 3A:
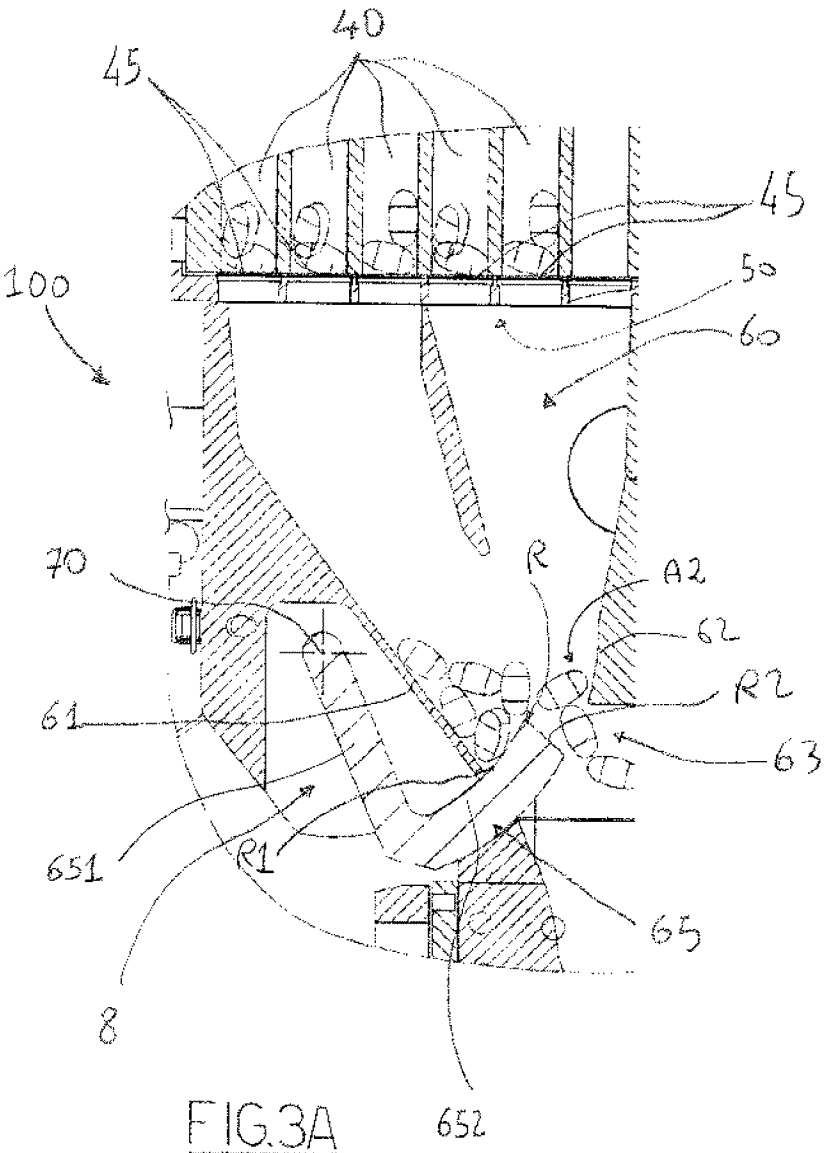
Figure 4C:
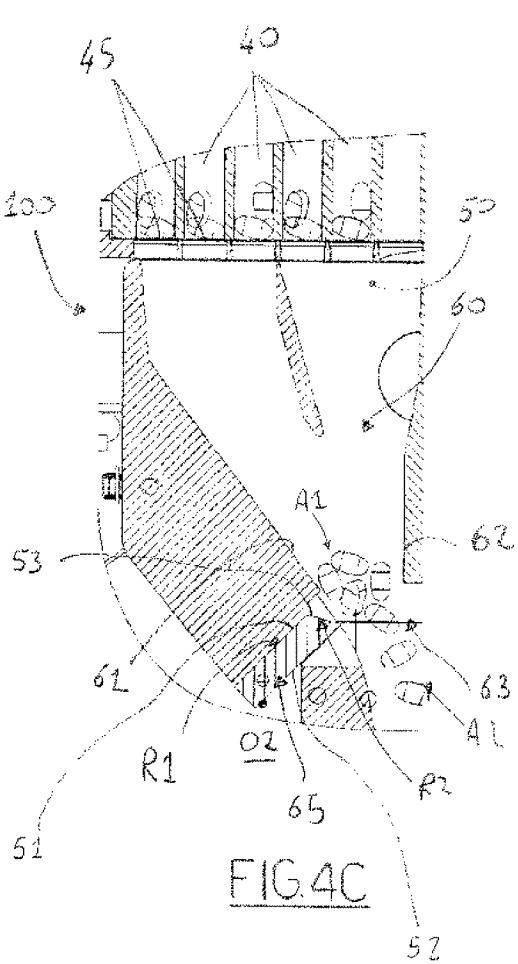
FIGS. 4B and 4C illustrate, in respective frontal and section views, the apparatus of FIG. 4A in an operating sequence of unloading of the pharmaceutical articles.

Further, the apparatus (100) is predisposed and configured in such a way that the closing element (65) is movable with respect to the unloading mouth (63) from the first closing position (O1) to the second open position (O2) in order first to move the second abutment surface (R2) away from the second internal wall (62) of the accumulation chamber (60) opening a first part of the unloading mouth (63) for the unloading of the second group (A2) of pharmaceutical articles (see FIG. 3A and FIG. 4B), and then to move away and completely remove the first abutment surface (R1) from the unloading mouth (63) for the unloading of the first group (A1) of pharmaceutical articles (see FIG. 3B and FIG. 4C).

The movement of the closing element (65) from the first closed position (O1) to the second open position (O2), in the above-described ways, takes place continuously, thus realising a progressive and continuous opening of the unloading mouth.

Therefore, owing to the particular conformation of the closing element (65) of the unloading mouth (63), and to the particular arrangement at the unloading mouth (63) when the closing element (65) is positioned in the first closed position (O1), it is possible, with the two abutment surfaces (R1, R2) arranged at an angle to one another, and inclined with respect to the two internal walls (61, 62) of the accumulation chamber (60), to define and identify two distinct accumulation volumes (V1, V2) for the pharmaceutical articles falling from the descent channels (40).

In this way, it is possible to accumulate the pharmaceutical articles which fall into the accumulation chamber (60) into at least two distinct groups (A1, A2) of pharmaceutical articles, a first group (A1) of pharmaceutical articles which accumulates in the first accumulation volume (V1), between the first abutment surface (R1) of the closing element (65) and the first internal wall (P1) of the accumulation chamber (60), and a second group (A2) of pharmaceutical articles which accumulates in the second accumulation volume (V2), between the second abutment surface (R2) of the closing element (65) and the second internal wall (P2) of the accumulation chamber (60).

Therefore, once the predetermined number of pharmaceutical articles necessary to fill the bottle has fallen into the accumulation chamber (60) and the blocking elements (45) of the descent channels (40) have been activated to close the descent channels (40), it will be possible, by moving the closing element (65) from the first closed position (O1) to the second open position (O2) of the unloading mouth (63), to unload first the second group (A2) of pharmaceutical articles (FIG. 3A and FIG. 4B) and then also the first group (A1) of pharmaceutical articles (FIG. 3B and FIG. 4C).

In this way, when the closing element (65) reaches the second open position (O2), all the pharmaceutical articles will have been unloaded via the unloading mouth.

With the apparatus of the invention it is therefore possible to carry out a continuous and progressive unloading of the pharmaceutical articles which accumulate inside the accumulation chamber, avoiding and obviating the drawbacks which occur in the apparatus of the prior art described in the foregoing.

The apparatus can comprise, beneath the unloading mouth, suitable connecting conduits (not illustrated) to connect the discharge mouth with the mouth of a bottle arranged paused beneath the apparatus from a conveying line.

Further, the apparatus comprises sensor means (not illustrated in detail as of known type), which are positioned so as to detect the pharmaceutical articles that fall internally of each descent channel (40), and which are configured in such a way as to provide a datum relative to the number of pharmaceutical articles present internally of each descent channel (40) and falling into the accumulation chamber (60), useful for the purpose of the activation of the blocking elements (45) of the descent channels (40) and therefore the movement of the closing element (65) from the first closed position (O1) to the second open position (O2).

Further advantageous aspects of the apparatus proposed by the present invention are described in the following.

The conformation of the closing element, in particular of the first abutment surface and the second abutment surface, the arrangement thereof at the unloading mouth and the mode of movement from the first closed position to the second open position, can vary on the basis of the shape, dimension and number of pharmaceutical articles to be accumulated in the accumulation chamber before the unloading thereof for filling a bottle, and therefore are not limited to the examples illustrated in the figures.

In any case, the closing element (65) is conformed in such a way that the first abutment surface (R1) and the second abutment surface (R2) are arranged at an angle to one another so as to form a separation cusp (R) of the first accumulation volume (V1) from the second accumulation volume (V2), to define and identify, internally of the accumulation chamber, two distinct volumes in which two groups of pharmaceutical articles can be accumulated distinctly from one another, which groups will then be unloaded one following another.

The apparatus can be realised and configured in such a way that the closing element (65) is movable between the first closing position (O1) and the second open position (O2) by means of a roto-translational movement or by means of a linear translational movement.

In a possible preferred embodiment, for example illustrated in FIGS. 2A-2B and 3A-3B, the closing element (65) is conformed in such a way as to comprise a first part (651), which is arranged externally of the accumulation chamber (60) and which is hinged rotatably to a hinge axis (70), and a second part (652), which is arranged at an angle with respect to the first part (652), destined to occupy the unloading mouth (63) of the accumulation chamber (60) in order to close the unloading mouth (63) when the closing element (65) is positioned in the first closed position (O1).

For example, in section, the closing element (65) can have an L-shape. In this case, the second part (652) of the closing element (65) is conformed in such a way as to define the first abutment surface (R1) and the second abutment surface (R2).

A maneuvering chamber (8) is included, flanked to and external of the accumulation chamber (60), such as to enable the rotation of the first part (651) of the closing element (65) with respect to the hinge axis (70) for the movement of the closing element (65) from the first closed position (O1) to the second open position (O2), and vice versa, and for housing the second part (652) of the closing element (65) when it is brought into the second open position (O2).

For the activation in rotation of the first part (651) of the closing element (65) with respect to the hinge axis (70) a shaft drivable in rotation via a relative motor means can be used.

Figure 4B:
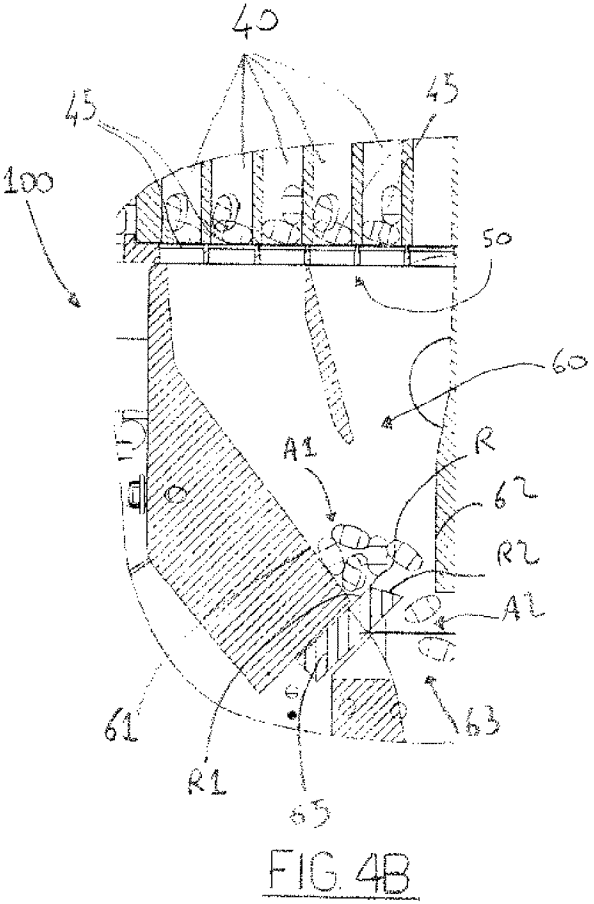
Figure 4A:
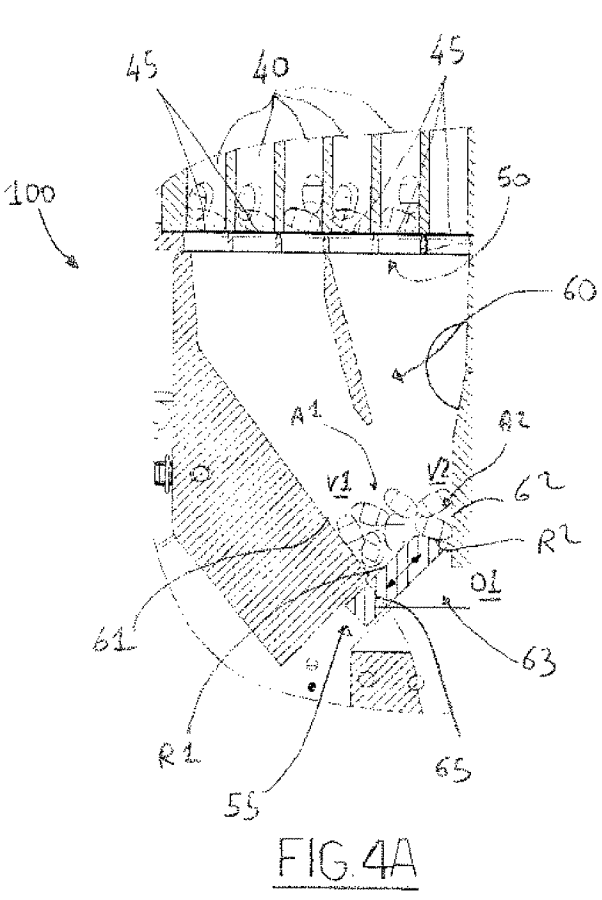
FIG. 4A schematically illustrates, in a frontal view and in vertical section, a possible further embodiment of the apparatus of the invention.

In another possible embodiment, illustrated in FIGS. 4A-4C, the closing element (65) is conformed in such a way as to be plate-shaped having a first wall (51), defining the first abutment surface (R1), a second wall (52) opposite the first wall (51), and a third wall (53) arranged inclined between the first wall (51) and the second wall (52) and defining the second abutment surface (R2).

In this case, the apparatus (100) comprises a guide and sliding channel (55), flanked to and external of the accumulation chamber (60), in order to enable the movement in translation of the closing element (65) from the first closed position (O1) to the second open position (O2), and vice versa. For the translation of the closing element (65) along the guide and sliding channel (55), a linear actuator can be used.

The invention claimed is:

1. An apparatus for counting and unloading pharmaceutical articles, comprising:

a plurality of descent channels configured so as to receive internally thereof pharmaceutical articles;

an accumulation chamber, arranged below the descent channels and having an entry mouth for receiving the pharmaceutical articles exiting from the descent channels and an unloading mouth for unloading the pharmaceutical articles;

blocking elements, activatable to open/close the descent channels, the blocking elements being activatable to open the descent channels and enable falling of the pharmaceutical articles in the accumulation chamber and to close the descent channels when a number of the pharmaceutical articles that have fallen into the accumulation chamber has reached a predetermined value;

a closing element which is arranged and movable with respect to the unloading mouth in such a way as to be movable between a first closed position (O1), in which the closing element is positioned at the unloading mouth, in order to close the B unloading mouth and enable accumulation of the pharmaceutical articles, and a second open position (O2), in which the closing element is completely removed from the unloading mouth in order to free and open the unloading mouth for unloading the pharmaceutical articles accumulated in the accumulation chamber, the closing element is configured and conformed in such a way as to comprise a first abutment surface and a second abutment surface which are arranged at an angle to one another, and wherein, the accumulation chamber and the closing element are reciprocally arranged and configured in such a way that, with the closing element being positioned in the first closed position (O1) at the unloading mouth in order to close the unloading mouth, the first abutment surface is arranged in the accumulation chamber inclined and with a first angle with respect to a first internal wall of the accumulation chamber defining a first accumulation volume (V1) for the pharmaceutical articles between the first abutment surface and the first internal wall, and the second abutment surface is arranged inside the accumulation chamber inclined and with a second angle with respect to a second internal wall of the accumulation chamber, opposite the first internal wall, defining a second accumulation volume (V2) for the pharmaceutical articles between the second abutment surface and the second internal wall, in such a way that the pharmaceutical articles falling from the descent channels can accumulate into a first group (A1) of pharmaceutical articles in the first accumulation volume (V1) and into a second group (A2) of pharmaceutical articles in the second accumulation volume, (V2), and in that the closing element is movable with respect to the unloading mouth from the first closing position (O1) to the second open position (O2) in order first to move the second abutment surface away from the second internal wall of the accumulation chamber opening a first part of the unloading mouth for the unloading of the second group (A2) of pharmaceutical articles, and then to move away and completely remove the first abutment surface from the unloading mouth for the unloading of the first group (A1) of pharmaceutical articles.

2. The apparatus of claim 1, wherein the closing element is movable between the first closing position (O1) and the second open position (O2) by means of a roto-translational movement or a linear-translational movement.

3. The apparatus of claim 2, wherein the closing element is conformed in such a way as to comprise a first part, arranged externally of the accumulation chamber and hinged rotatably to a hinge axis, and a second part, arranged at an angle with respect to the first part, destined to occupy the unloading mouth of the accumulation chamber in order to close the unloading mouth when the closing element is positioned in the first closed position (O1), wherein the second part is conformed in such a way as to define the first abutment surface and the second abutment surface.

4. The apparatus of claim 3, comprising a maneuvering chamber, flanked to and external of the accumulation chamber, such as to enable the rotation of the first part of the closing element with respect to the hinge axis for the movement of the closing element from the first closed position (O1) to the second open position (O2), and vice versa.

5. The apparatus of claim 2, wherein the closing element is plate-shaped having a first wall, defining the first abutment surface, a second wall opposite the first wall, and a third wall arranged inclined between the first wall and the second wall and defining the second abutment surface.

6. The apparatus of claim 5, comprising a guide and sliding channel, flanked to and external of the accumulation chamber, in order to enable the movement in translation of the closing element from the first closed position (O1) to the second open position (O2), and vice versa.

7. The apparatus of claim 1, wherein the first abutment surface and the second abutment surface are arranged at an angle to one another so as to form a separation cusp of the first accumulation volume (V1) from the second accumulation volume (V2).

8. An apparatus for counting and unloading pharmaceutical articles, comprising:

a plurality of descent channels configured so as to receive internally thereof pharmaceutical articles;

an accumulation chamber arranged below the descent channels and having an entry mouth for receiving the pharmaceutical articles exiting from the descent channels and an unloading mouth for unloading the pharmaceutical articles;

blocking elements being activatable to open the descent channels and enable falling of the pharmaceutical articles in the accumulation chamber and to close the descent channels when a number of the pharmaceutical articles that have fallen into the accumulation chamber has reached a predetermined value;

a closing element which is arranged and movable with respect to the unloading mouth in such a way as to be movable between a first closed position (O1) in which the closing element is positioned at the unloading mouth in order to close the unloading mouth and enable accumulation of the pharmaceutical articles, and a second open position (O2) in which the closing element is completely removed from the unloading mouth in order to free and open the unloading mouth for unloading the pharmaceutical articles accumulated in the accumulation chamber, the closing element including a first abutment surface and a second abutment surface, the first and second abutment surfaces being arranged at an angle to one another, the accumulation chamber and the closing element being reciprocally arranged and configured in such a way that, with the closing element being positioned in the first closed position (O1) at the unloading mouth in order to close the unloading mouth, the first abutment surface is arranged in the accumulation chamber inclined and with a first angle with respect to a first internal wall of the accumulation chamber defining a first accumulation volume (V1) for the pharmaceutical articles between the first abutment surface and the first internal wall, and the second abutment surface is arranged inside the accumulation chamber inclined and with a second angle with respect to a second internal wall of the accumulation chamber, opposite the first internal wall, defining a second accumulation volume (V2) for the pharmaceutical articles between the second abutment surface and the second internal wall, in such a way that the pharmaceutical articles falling from the descent channels can accumulate into a first group (A1) of pharmaceutical articles in the first accumulation volume (V1) and into a second group (A2) of pharmaceutical articles in the second accumulation volume (V2), the closing element being movable with respect to the unloading mouth from the first closing position (O1) to the second open position (O2) in order first to move the second abutment surface away from the second internal wall of the accumulation chamber opening a first part of the unloading mouth for the unloading of the second group (A2) of pharmaceutical articles, and then to move away and completely remove the first abutment surface from the unloading mouth for the unloading of the first group (A1) of pharmaceutical articles, and wherein the first abutment surface and the second abutment surface are arranged at an angle to one another so as to form a separation cusp of the first accumulation volume (V1) from the second accumulation volume, and wherein the closing element is conformed in such a way as to comprise a first part, arranged externally of the accumulation chamber and hinged rotatably to a hinge axis, and a second part arranged at an angle with respect to the first part occupies the unloading mouth of the accumulation chamber to close the unloading mouth when the closing element is positioned in the first closed position (O1), and wherein the second part is conformed in such a way as to define the first abutment surface and the second abutment surface.

9. The apparatus of claim 8, comprising a maneuvering chamber flanked to and external of the accumulation chamber to enable the rotation of the first part of the closing element with respect to the hinge axis for the movement of the closing element from the first closed position (O1) to the second open position (O2), and vice versa.

10. The apparatus of claim 8, wherein the first abutment surface and the second abutment surface are arranged at an angle to one another so as to form a separation cusp of the first accumulation volume (V1) from the second accumulation volume (V2).

11. An apparatus for counting and unloading pharmaceutical articles, comprising:

a plurality of descent channels configured so as to receive internally thereof pharmaceutical articles;

an accumulation chamber arranged below the descent channels and having an entry mouth for receiving the pharmaceutical articles exiting from the descent channels and an unloading mouth for unloading the pharmaceutical articles;

blocking elements being activatable to open the descent channels and enable falling of the pharmaceutical articles in the accumulation chamber and to close the descent channels when a number of the pharmaceutical articles that have fallen into the accumulation chamber has reached a predetermined value;

a closing element which is arranged and movable with respect to the unloading mouth in such a way as to be movable between a first closed position (O1) in which the closing element is positioned at the unloading mouth in order to close the unloading mouth and enable accumulation of the pharmaceutical articles, and a second open position (O2) in which the closing element is completely removed from the unloading mouth in order to free and open the unloading mouth for unloading the pharmaceutical articles accumulated in the accumulation chamber, the closing element including a first abutment surface and a second abutment surface, the first and second abutment surfaces being arranged at an angle to one another, the accumulation chamber and the closing element being reciprocally arranged and configured in such a way that, with the closing element being positioned in the first closed position (O1) at the unloading mouth in order to close the unloading mouth, the first abutment surface is arranged in the accumulation chamber inclined and with a first angle with respect to a first internal wall of the accumulation chamber defining a first accumulation volume (V1) for the pharmaceutical articles between the first abutment surface and the first internal wall, and the second abutment surface is arranged inside the accumulation chamber inclined and with a second angle with respect to a second internal wall of the accumulation chamber, opposite the first internal wall, defining a second accumulation volume (V2) for the pharmaceutical articles between the second abutment surface and the second internal wall, in such a way that the pharmaceutical articles falling from the descent channels can accumulate into a first group (A1) of pharmaceutical articles in the first accumulation volume (V1) and into a second group (A2) of pharmaceutical articles in the second accumulation volume (V2), the closing element being movable with respect to the unloading mouth from the first closing position (O1) to the second open position (O2) in order first to move the second abutment surface away from the second internal wall of the accumulation chamber opening a first part of the unloading mouth for the unloading of the second group (A2) of pharmaceutical articles, and then to move away and completely remove the first abutment surface from the unloading mouth for the unloading of the first group (A1) of pharmaceutical articles, and wherein the first abutment surface and the second abutment surface are arranged at an angle to one another so as to form a separation cusp of the first accumulation volume (V1) from the second accumulation volume (V2), and wherein the closing element is plate-shaped having a first wall, defining the first abutment surface, a second wall opposite the first wall, and a third wall arranged inclined between the first wall and the second wall and defining the second abutment surface.

12. The apparatus of claim 11, comprising a guide and sliding channel, flanked to and external of the accumulation chamber, in order to enable the movement in translation of the closing element from the first closed position (O1) to the second open position, and vice versa.

13. The apparatus of claim 11, wherein the first abutment surface and the second abutment surface are arranged at an angle to one another so as to form a separation cusp of the first accumulation volume (V1) from the second accumulation volume (V2).

* * * * *